US006344830B1

(12) United States Patent
Taylor

(10) Patent No.: US 6,344,830 B1
(45) Date of Patent: Feb. 5, 2002

(54) PHASED ARRAY ANTENNA ELEMENT HAVING FLARED RADIATING LEG ELEMENTS

(75) Inventor: Robert C. Taylor, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/638,720

(22) Filed: Aug. 14, 2000

(51) Int. Cl.[7] ..... H01Q 13/10
(52) U.S. Cl. ..... 343/767; 343/770
(58) Field of Search ..... 343/757, 767, 343/770, 785, 786; H01Q 13/10, 13/18, 21/00, 21/24

(56) References Cited

U.S. PATENT DOCUMENTS

| | | | | | |
|---|---|---|---|---|---|
| 3,710,258 | A | * | 1/1973 | Strenglein | 325/105 |
| 4,283,729 | A | | 8/1981 | Richardson | 343/854 |
| 4,758,842 | A | | 7/1988 | Linhardt et al. | 343/786 |
| 4,843,403 | A | * | 6/1989 | Lalezari et al. | 343/767 |
| 4,931,808 | A | * | 6/1990 | Lalezari et al. | 343/753 |
| 5,117,240 | A | | 5/1992 | Anderson et al. | 343/786 |
| 5,175,560 | A | | 12/1992 | Lucas et al. | 343/767 |
| 5,311,199 | A | * | 5/1994 | Fraschilla et al. | 343/767 |
| 5,461,392 | A | * | 10/1995 | Mott et al. | 343/725 |
| 5,568,159 | A | * | 10/1996 | Pelton et al. | 343/767 |
| 5,606,331 | A | | 2/1997 | McCorkle | 343/786 |
| 5,898,402 | A | | 4/1999 | Kilpatrick | 342/417 |
| 5,898,409 | A | | 4/1999 | Holzman | 343/786 |
| 5,938,612 | A | | 8/1999 | Kline-Schoder et al. | 600/459 |
| 5,943,011 | A | | 8/1999 | Acoraci et al. | 342/373 |
| 5,959,591 | A | * | 9/1999 | Aurand | 343/786 |
| 5,973,653 | A | | 10/1999 | Kragalott et al. | 343/786 |
| 6,127,984 | A | | 10/2000 | Klebe et al. | 343/770 |
| 6,219,000 | B1 | | 4/2001 | McWhirter et al. | 343/767 |

* cited by examiner

*Primary Examiner*—Tho G. Phan
(74) *Attorney, Agent, or Firm*—Allen, Dyer, Doppelt, Milbrath & Gilchrist, P.A.

(57) ABSTRACT

A phased array antenna element includes an antenna support and two longitudinally extending radiating leg elements supported by the antenna support and flared outward in a v-configuration from a vertex to antenna element tips. A resistive element is positioned on each radiating leg element and has a resistive value along the radiating leg elements from a low loss at the vertex to a high loss at the antenna element tips. The radiating leg elements are curved outward along their length and form a triangular configuration having a height that is about three times greater than the base.

30 Claims, 5 Drawing Sheets

PHASED ARRAY ANTENNA ELEMENT HAVING FLARED RADIATING LEG ELEMENTS

FIELD OF THE INVENTION

This invention relates to phased ray antennas, and more particularly, this invention relates to wideband phased array antenna elements with a wide scan angle.

BACKGROUND OF THE INVENTION

The development of wideband phased array antenna elements are becoming increasingly important in this telecommunications era when the frequencies in communications range from a minimum of 2 GHz to 18 GHz. Some of these applications require dual polarization antenna elements, a scan angle range of +/−45 degrees with low scan loss, and a low loss, lightweight, low profile that is easy to manufacture and uses power in the multiple watts range.

Currently, the common problem of obtaining a wideband phased array antenna with a wide scan angle and reasonable power handling is being solved by various methods. These methods include the use of an antenna and system that divides the frequency range into two or more bands, which results in considerable more mass and volume plus a radio frequency interface problem. Other methods include an antenna structure using a mechanical gimbal to obtain the required scan angle. This type of antenna element and system again results in more mass, volume, and slow response time. The development of space qualified materials and analysis tools, however, could contribute to new solutions to this problem.

SUMMARY OF THE INVENTION

The present invention is advantageous and provides a phased array antenna element that includes an antenna support and longitudinally extending radiating leg elements supported by the antenna support and flared outward in a v-configuration from a vertex to antenna element tips. A resistive element is positioned on each radiating leg element and has a resistive value along the radiating leg elements from a low loss at the vertex to a high loss at the antenna element tips. Each resistive element is formed from a plastic film and includes a plurality of overlapping strips. The radiating leg elements are formed from a foam material, in yet another aspect of the present invention, and curved outward along their length. They form a triangular configuration and can have a height that is about three times greater than the base.

The antenna support can comprise a support plate that is horizontally positioned relative to the radiating leg elements and include orifices for receiving attachment fasteners and attaching the phased array antenna element onto a mounting surface. Each radiating leg element includes an inside edge on which the resistive element is positioned.

In yet another aspect of the present invention, four radiating leg elements are spaced 90° apart from each other and form an antenna having dual polarization.

A radio frequency coaxial feed input can be mounted on the antenna support and a metallic strip feed can interconnect radio frequency coaxial feed input and resistive elements. In still another aspect of the present invention, a 0/180° hybrid circuit can be connected to the radio frequency coaxial feed input.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

The present invention is advantageous and provides a wideband phased array antenna element, which in one aspect, includes two longitudinally extending radiating leg elements supported by an antenna support and positioned in a straight v-configuration from a vertex to antenna element tips. The radiating leg elements provide a low loss at a vertex to a high loss at the antenna element tips. In order to launch the wave early, resistive materials are used to load the waveguides and have a resistive element positioned on each radiating leg element. The resistive value varies along the radiating leg elements from a low loss at the vertex to a high loss at the antenna element clips. In a preferred aspect of the present invention, the radiating leg elements flare outward.

Figure 1:
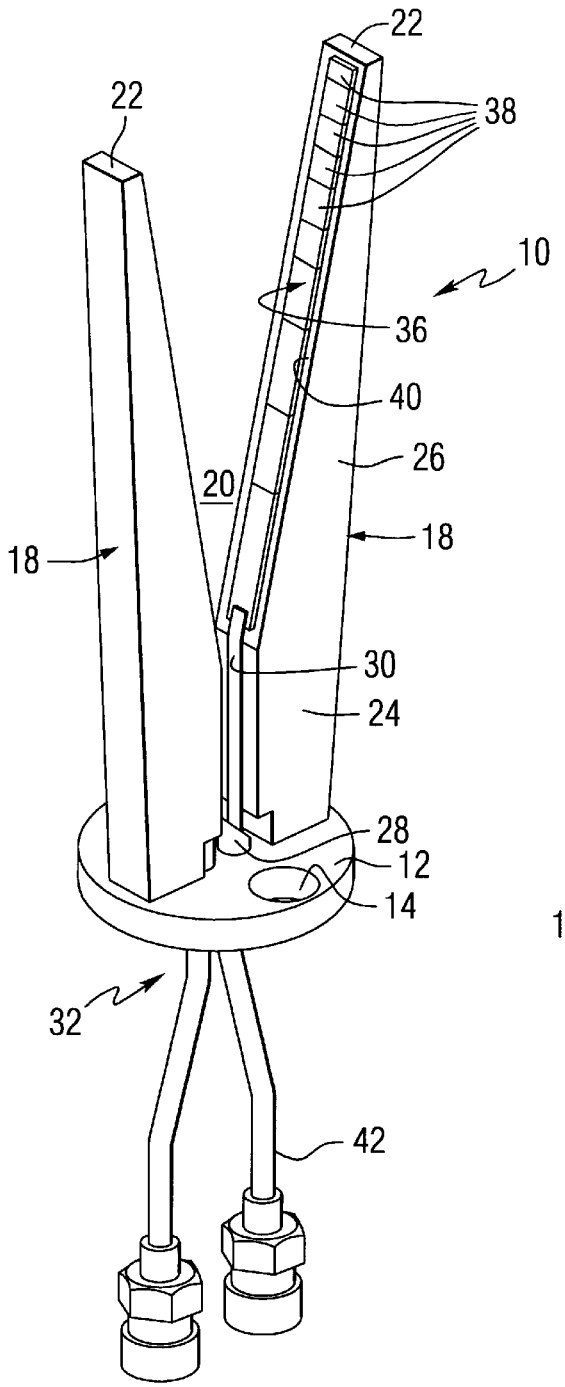
FIG. 1 is a general perspective view of a phased array antenna element showing an antenna support and two longitudinally extending radiating leg elements positioned in a straight v-configuration.
Figure 2:
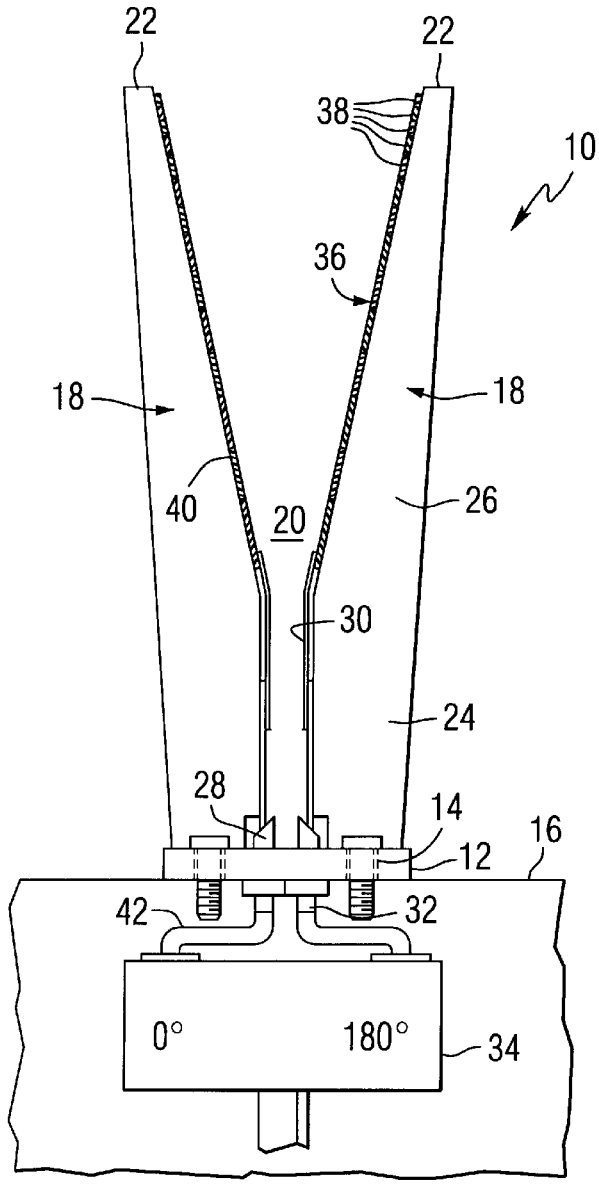
FIG. 2 is a schematic, side elevation view of the straight v-configuration phased array antenna element of FIG. 1.
Figure 3:
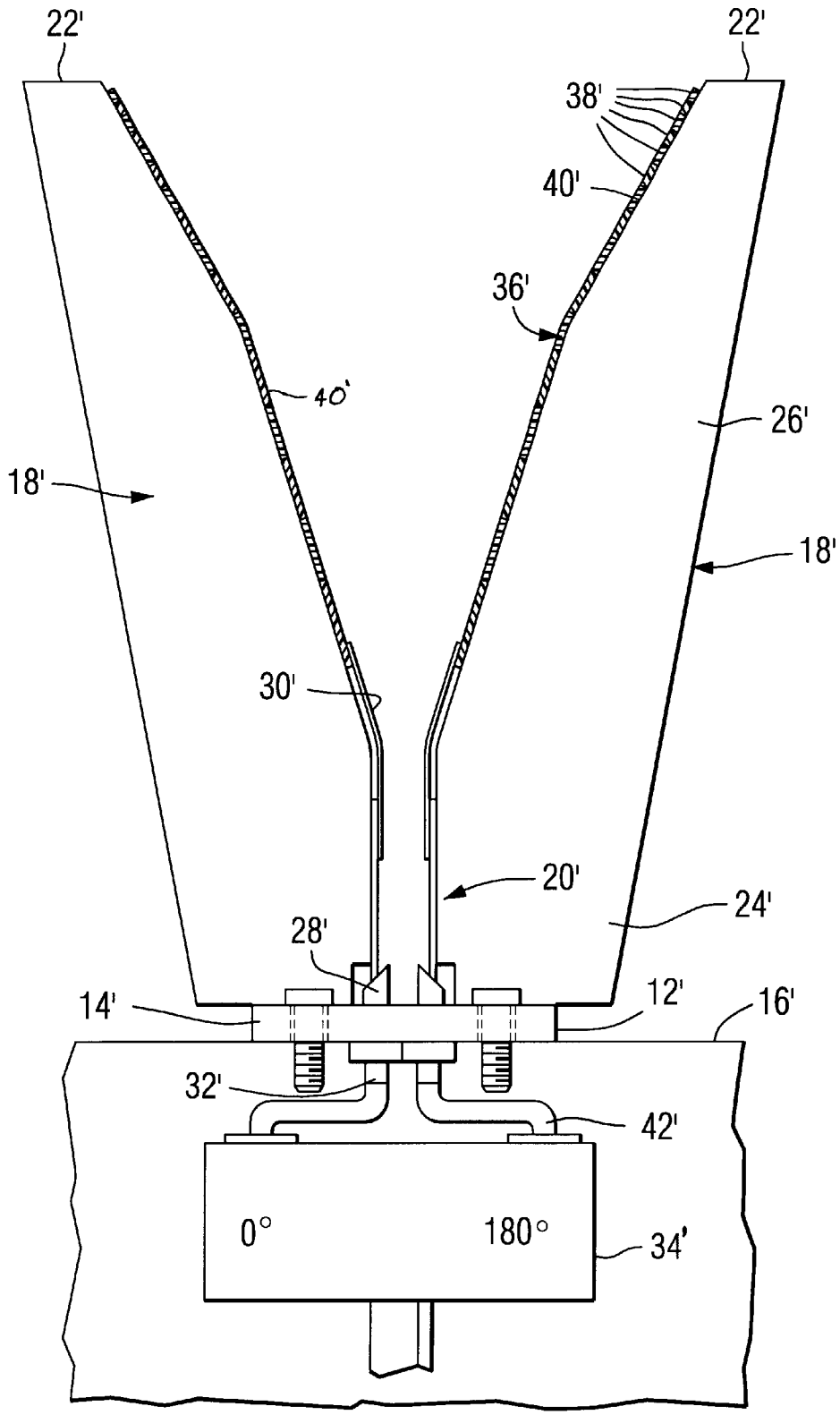
FIG. 3 is a schematic, side elevation view of another embodiment of the phased array antenna element having radiating leg elements that are flared outward in a v-configuration.
Figure 4:
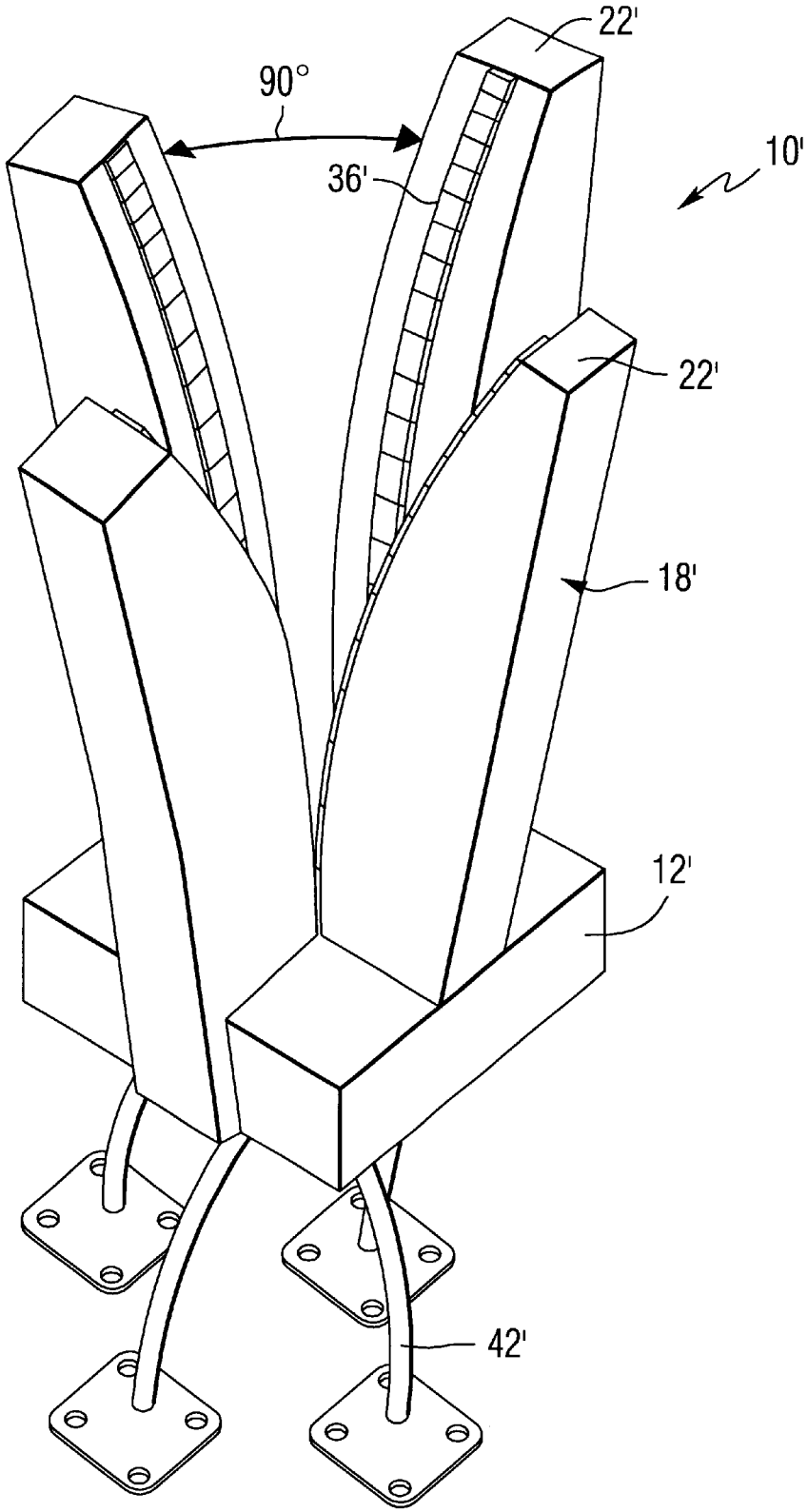
FIG. 4 is a general perspective view of a phased array antenna element using four radiating leg elements flared outward and separated 90 degrees apart from each other.
Figure 5:
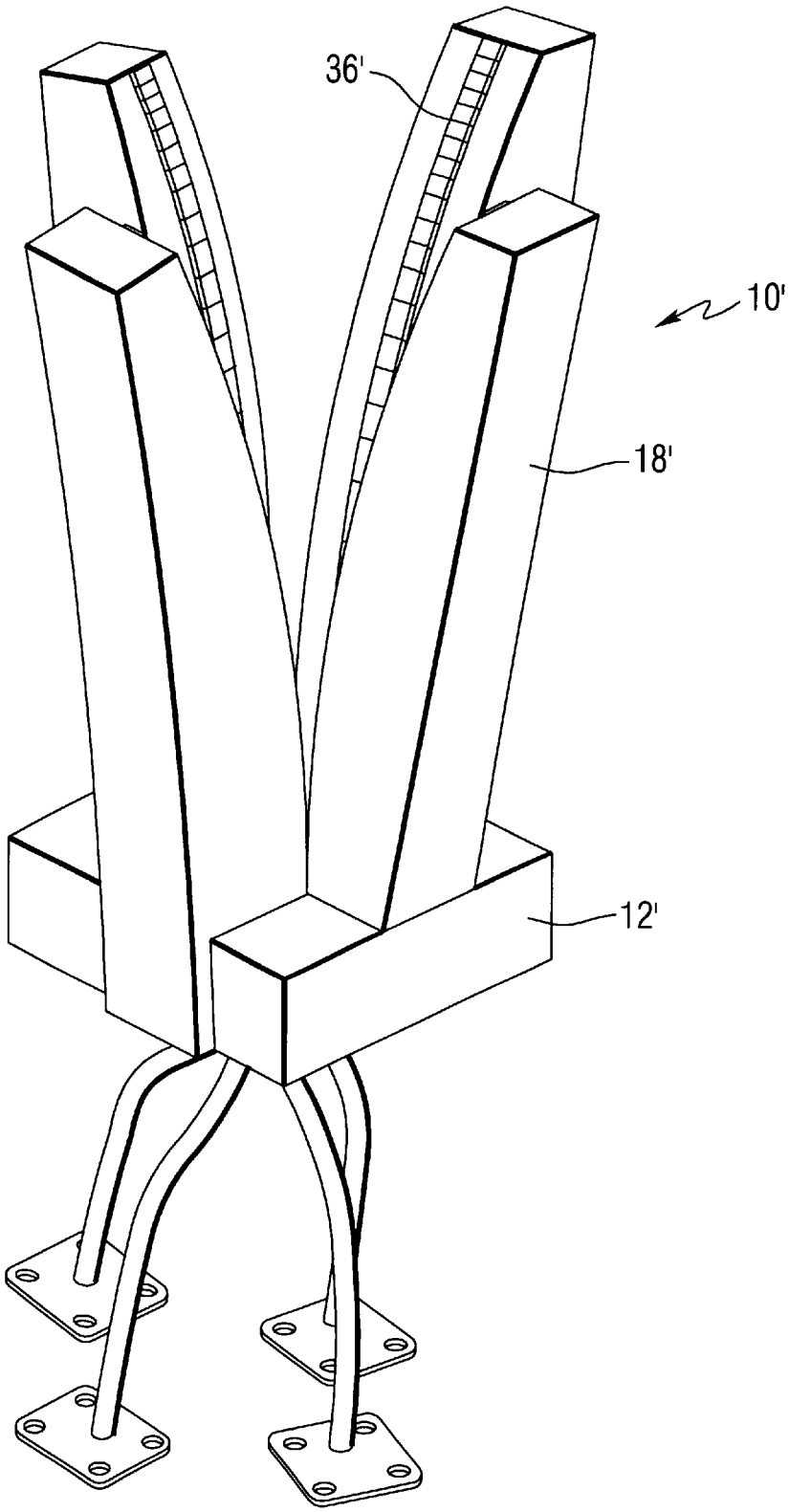
FIG. 5 is another perspective view of the phased array antenna element shown in FIG. 4.
Figure 6:
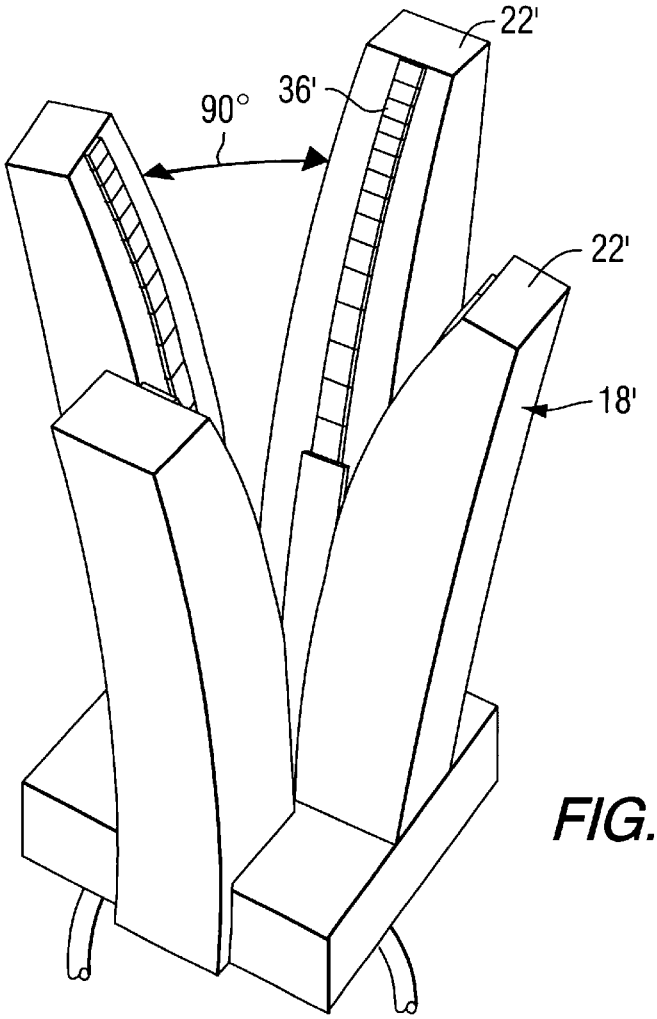
FIG. 6 is yet another perspective view of the phased array antenna element shown in FIG. 4.
Figure 7:
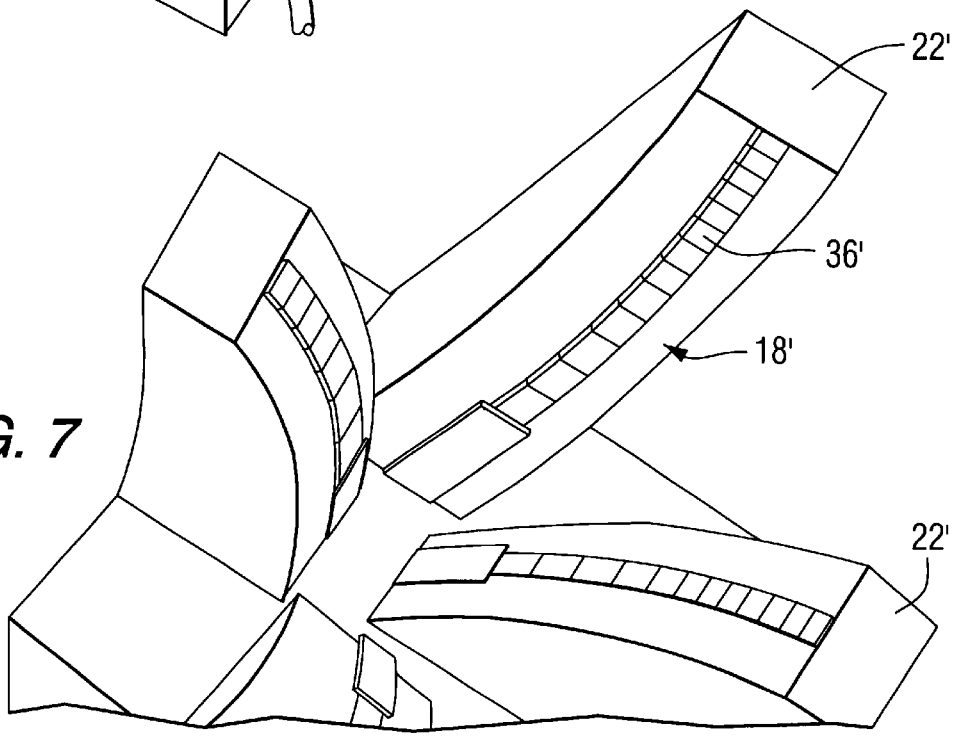
FIG. 7 is another perspective view of the phased array antenna element shown in FIG. 4 and looking into the vertex from the top portion of the antenna element.

Referring now to FIG. 1, there is illustrated a first embodiment and showing a phased array antenna element 10 in accordance with one aspect of the present invention. A circular and horizontally configured, planar antenna support 12 is formed as a support plate and includes orifices 14 to receive fasteners, such as bolts, to attach the antenna support as a mounting plate onto a fixed support surface 16 as shown in FIGS. 2 and 3.

In the embodiment shown in FIG. 1, two longitudinally extending radiating leg elements 18 are supported by the antenna support 12 and extend vertically in a straight v-configuration from a vertex 20 formed by the two leg elements to the antenna element tips 22. As shown, each longitudinally extending radiating leg element 18 includes a substantially rectangular configured base portion 24 and a triangular configured radiating leg element 26 to form as a whole unit, a trapezoid configured structure as best shown in FIG. 2.

In one aspect of the present invention, each radiating leg element 18 has a low loss at the vertex and ranges to a high loss at the antenna element tips 22. In one aspect, this can be accomplished by a strip of radiating and conductive material applied onto the inside edge of each radiating leg element as explained below. Although it is possible to use the antenna element with just a v-configuration without the additional low/high loss structure, it is better operated with such structure.

The radiating leg elements 18 are formed from a foam material in one aspect of the present invention and give a low weight and structural stability to the structure. Other materials known to those skilled in the art can be used. The radiating leg elements 18 form an angle of about 22° in one aspect of the invention. A radio frequency coaxial feed input 28 is mounted on the antenna element 10 as shown in FIG. 2. A conductive feed line 30 interconnects the radio frequency coaxial feed input 28 and each radiating leg element. The radio frequency coaxial feed input can comprise two center conductors 32 to feed the array element and are connected into a 0° and 180° hybrid 34, as known to those skilled in the art.

In another aspect of the present invention, the radiating leg elements 18 include a resistive element 36 positioned on each radiating leg element 18 and having a resistive value along the radiating leg elements ranging from a low loss at the vertex 20 to a high loss at the antenna element tips 22. Each resistive element is formed from a plastic film, and as shown in FIG. 1, is formed from a plurality of overlapping strips 38. An example of a plastic film that can be used is the translucent window film commonly used to limit the sunlight entering a window. It is also possible to use more technically advanced "space qualified " films.

As shown in FIG. 1, the longitudinally extending overlapping strips 38 are applied on the inside edge 40 of each conductor feed leg. For example, a first longitudinally extending resistive element 36 is formed as a film and is applied to extend along the inside edge 40 of the radiating leg element. A second, but shorter in length, resistive element is then applied and this process repeated until the shortest strip of resistive element is applied adjacent the tip. The strips will allow a low loss at the vertex and a high loss at the antenna elements because of the progressive resistance increase from the vertex to the tip. An example of a resistive value range are about 1,000 ohms per square at the tip to about three ohms per square at the apex.

This progressively increasing resistive load from the apex to the tip has been an improvement to many of the problems with early wavelength launch. It is possible to obtain a 7:1 bandwidth with a +/−45° scan and single polarization. In the phased array antenna element shown in FIGS. 1 and 2, a 0.085" radio frequency coaxial line feed tube 42 is connected to the radio frequency coaxial feed input 28, mounted on the antenna support. A conductive feed line 30 in the form of a copper tape in one aspect interconnects the radio frequency coaxial feed input 28, and each radiating leg element, which in the illustrated embodiment of FIGS. 1 and 2, include the resistive element positioned on each radiating leg element. Although copper tape is described as interconnecting the coaxial feed and the resistive elements, other conductive materials, as known to those skilled in the art, can also be used.

As to the dimensions of the radiating leg elements shown in FIGS. 1 and 2, in one embodiment, the inside edge 40 containing the resistive element can be about two inches, and in one embodiment, is about 2.13 inches. The total height of the radiating leg elements based upon the height of the formed triangle is about three inches and the tips are spaced about one inch apart, forming about a 22° angle. The distance from the lower edge of the resistivity element to the intersection line formed at a vertex of both inside edges can be about one-half inch. The coaxial line feeds can include fastener members as shown in FIG. 1, to allow the coaxial line feeds to attach to standard radio frequency inputs/outputs.

FIG. 3 shows an alternative embodiment of the phased array antenna element 10' where the radiating leg elements do not form a straight v-configuration. For purposes of illustration, the flared embodiment is given reference numerals with prime notation. Instead, the radiating leg elements 18' are flared outward in a v-configuration from the vertex 20' to the antenna element tips 22' and are curved outward along their length. Radiating leg elements 18' form a triangular configuration having a height that is about three times greater than the base. Dimensions could be similar to dimensions as previously discussed relative to the embodiment of FIG. 1. This configuration allows launching of the wave even earlier and increases performance.

FIGS. 4–7 illustrate yet another improvement where four flared radiating leg elements as in FIG. 3 are spaced 90° apart from each other. The embodiments shown in FIGS. 4–7 allow even greater control over the antenna performance and will use more adaptable hybrid circuit and allow dual polarization with the 90° angular spacing.

This application is related to copending patent applications entitled, "PHASED ARRAY ANTENNA ELEMENT WITH STRAIGHT V-CONFIGURATION RADIATING LEG ELEMENTS," which is filed on the same date and by the same assignee and inventors, the disclosure which is hereby incorporated by reference.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. A phased array antenna element comprising:

an antenna support;

longitudinally extending radiating leg elements supported by the antenna support and flared outward in a v-configuration from a vertex to antenna element tips wherein each radiating leg element is formed as a non-conductive leg element having a conductive inside edge; and a resistive element positioned on each conductive inside edge of said radiating leg element and having a resistive value along the radiating leg elements from a low loss at the vertex to a high loss at the antenna element tips.

2. A phased array antenna element according to claim 1, wherein each resistive element is formed from a plastic film.

3. A phased array antenna element according to claim 2, wherein each resistive element is formed from a plurality of overlapping strips.

4. A phased array antenna element according to claim 1, wherein said radiating leg elements are formed from a foam material.

5. A phased array antenna element according to claim 1, wherein said conductive inside edge of said radiating leg elements are curved outward along their length.

6. A phased array antenna element according to claim 1, wherein said radiating leg elements form a triangular configuration having a base, wherein the height of each radiating leg element is about three times greater than the base.

7. A phased array antenna element according to claim 1, wherein said antenna support comprises a support plate horizontally positioned to the radiating leg elements.

8. A phased array antenna element according to claim 7, wherein said support plate includes orifices for receiving attachment fasteners.

9. A phased array antenna element according to claim 1, wherein each radiating leg element includes an inside edge on which the resistive element is positioned.

10. A phased array antenna element according to claim 1, and comprising four radiating leg elements spaced 90 degrees apart from each other.

11. A phased array antenna element comprising:

an antenna support;

longitudinally extending radiating leg elements supported by the antenna support and flared outward in a v-configuration from a vertex to antenna element tips wherein each radiating leg element is formed as a non-conductive leg element having a conductive inside edge;

a resistive element positioned on each conductive inside edge of said radiating leg element and having a resistive value along the radiating leg elements from a low loss at the vertex to a high loss at the antenna element tips;

a radio frequency coaxial feed input mounted on the antenna support; and a metallic strip feed interconnecting the radio frequency coaxial feed input and resistive elements.

12. A phased array antenna element according to claim 11, wherein each resistive element is formed from a plastic film.

13. A phased array antenna element according to claim 12, wherein each resistive element is formed from a plurality of overlapping strips.

14. A phased array antenna element according to claim 11, wherein said radiating leg elements are formed from a foam material.

15. A phased array antenna element according to claim 11, wherein said conductive inside edge of said radiating leg elements are curved outward along their length.

16. A phased array antenna element according to claim 11, wherein said radiating leg elements form a triangular configuration having a base, wherein the height of each radiating leg element is about three times greater than the base.

17. A phased array antenna element according to claim 11, wherein said antenna support comprises a support plate horizontally positioned to the radiating leg elements.

18. A phased array antenna element according to claim 17, wherein said support plate includes orifices for receiving attachment fasteners.

19. A phased array antenna element according to claim 11, wherein each radiating leg element includes an inside edge on which said resistive element is positioned.

20. A phased array antenna element according to claim 11, and comprising four radiating leg elements spaced about 90 degrees apart from each other.

21. A phased array antenna element comprising:

an antenna support;

longitudinally extending radiating leg elements supported by the antenna support and flared outward in a v-configuration from a vertex to antenna element tips wherein each radiating leg element is formed as a non-conductive leg element having a conductive inside edge; and a resistive element positioned on each conductive inside edge of said radiating leg element and having a resistive value along the radiating leg elements from a low loss at the vertex to a high loss at the antenna element tips;

a radio frequency coaxial feed input mounted on the antenna support;

a metallic strip feed interconnecting the radio frequency coaxial feed input and resistive elements; and a 0/180 degree hybrid circuit connected to the radio frequency coaxial feed input.

22. A phased array antenna element according to claim 21, wherein each resistive element is formed from a plastic film.

23. A phased array antenna element according to claim 22, wherein each resistive element is formed from a plurality of overlapping strips.

24. A phased array antenna element according to claim 21, wherein said radiating leg elements are formed from a foam material.

25. A phased array antenna element according to claim 21, wherein said conductive inside edge of said radiating leg elements are curved outward along their length.

26. A phased array antenna element according to claim 21, wherein said radiating leg elements form a triangular configuration having a base, wherein the height of each radiating leg element is about three times greater than the base.

27. A phased array antenna element according to claim 21, wherein said antenna support comprises a support plate horizontally positioned to the radiating leg elements.

28. A phased array antenna element according to claim 27, wherein said support plate includes orifices for receiving attachment fasteners.

29. A phased array antenna element according to claim 21, wherein each radiating leg element includes an inside edge on which the resistive element is positioned.

30. A phased array antenna element according to claim 21, and comprising four radiating leg elements positioned about 90 degrees apart from each other.

* * * * *